United States Patent [19]

Harrington et al.

[11] 4,316,352

[45] Feb. 23, 1982

[54] WINDOW FRAME AND METHOD OF ASSEMBLY THEREOF

[76] Inventors: William S. Harrington, 1711 Jacquelyn #32, Houston, Tex. 77055; Richard T. Farley, 9623 Grant Rd. #4, Houston, Tex. 77070

[21] Appl. No.: 124,355

[22] Filed: Feb. 25, 1980

Related U.S. Application Data

[63] Continuation of Ser. No. 954,857, Oct. 26, 1978, abandoned.

[51] Int. Cl.[3] ..... E04C 2/38

[52] U.S. Cl. ..... 52/656; 52/235; 52/731; 52/456

[58] Field of Search ..... 52/730, 731, 664, 666, 52/455, 456, 656, 235, 238, 239; 403/230, 263; 256/65

[56] References Cited

U.S. PATENT DOCUMENTS

| | | | |
|---|---|---|---|
| 3,140,763 | 7/1964 | Edelstein | 52/235 |
| 3,209,869 | 10/1965 | Hammitt | 52/239 |
| 3,265,416 | 8/1966 | Downes | 52/238 |
| 3,266,210 | 8/1966 | Grossman | 52/235 |
| 3,343,318 | 9/1967 | Brum | 52/239 |
| 3,552,077 | 1/1971 | Hemminger | 52/456 |
| 3,579,943 | 5/1971 | Tam | 52/656 |
| 3,690,079 | 9/1972 | Hemminger | 52/235 |
| 3,736,717 | 6/1973 | Furley | 52/235 |
| 3,835,613 | 9/1974 | Davies, Jr. | 52/656 |
| 3,892,054 | 7/1975 | Matson | 403/230 |
| 3,932,974 | 1/1976 | Wright | 52/235 |
| 3,989,399 | 11/1976 | Slowbe | 403/230 |
| 4,013,371 | 3/1977 | Nagase | 52/455 |
| 4,047,342 | 9/1977 | Boulva | 52/239 |
| 4,047,703 | 9/1977 | Murdock | 403/263 |

*Primary Examiner*—Price C. Faw, Jr.
*Assistant Examiner*—Henry E. Raduazo
*Attorney, Agent, or Firm*—Robert W. B. Dickerson

[57] ABSTRACT

Frame comprised of I-beam verticals linked by spaced horizontals, fillers serving to separate the horizontals. Assembly involves inserting the horizontals within facing I-beam channels and separating said horizontals by fillers snapped into the I-beam channels.

1 Claim, 5 Drawing Figures

WINDOW FRAME AND METHOD OF ASSEMBLY THEREOF

This is a continuation of application Ser. No. 954,857, filed Oct. 26, 1978 now abandoned.

BACKGROUND OF THE INVENTION

Heretofore, there have been two generally accepted methods of fabricating and installing aluminum frames in commercial buildings. One of these methods utilizes screw-applied clips at the juncture of vertical and horizontal frame members. This usually requires frame fabrication in the field. The second established method uses screw raceways and fillers to link vertical and horizontal frame members. Normally, with this method, the verticals must be drilled in the plant and screw raceways built into or fixed to the horizontals. While this reduces field time, it substantially increases plant time. This invention has as its prime goal a frame and method of assembly that permits quick field installation, with a minimum of plant time.

SUMMARY OF THE INVENTION

I-beam aluminum verticals may be cut, in the field, to an appropriate length. One such vertical is anchored to the window opening, and a bottom horizontal is snapped into two adjacent verticals; a filler is then snapped into the facing I-beam channels, and another horizontal snapped into the verticals atop the fillers, which process continues until the topmost horizontal is in place, at which time the frame is complete, and ready for glass installation.

DESCRIPTION OF A PREFERRED EMBODIMENT

Figure 1:
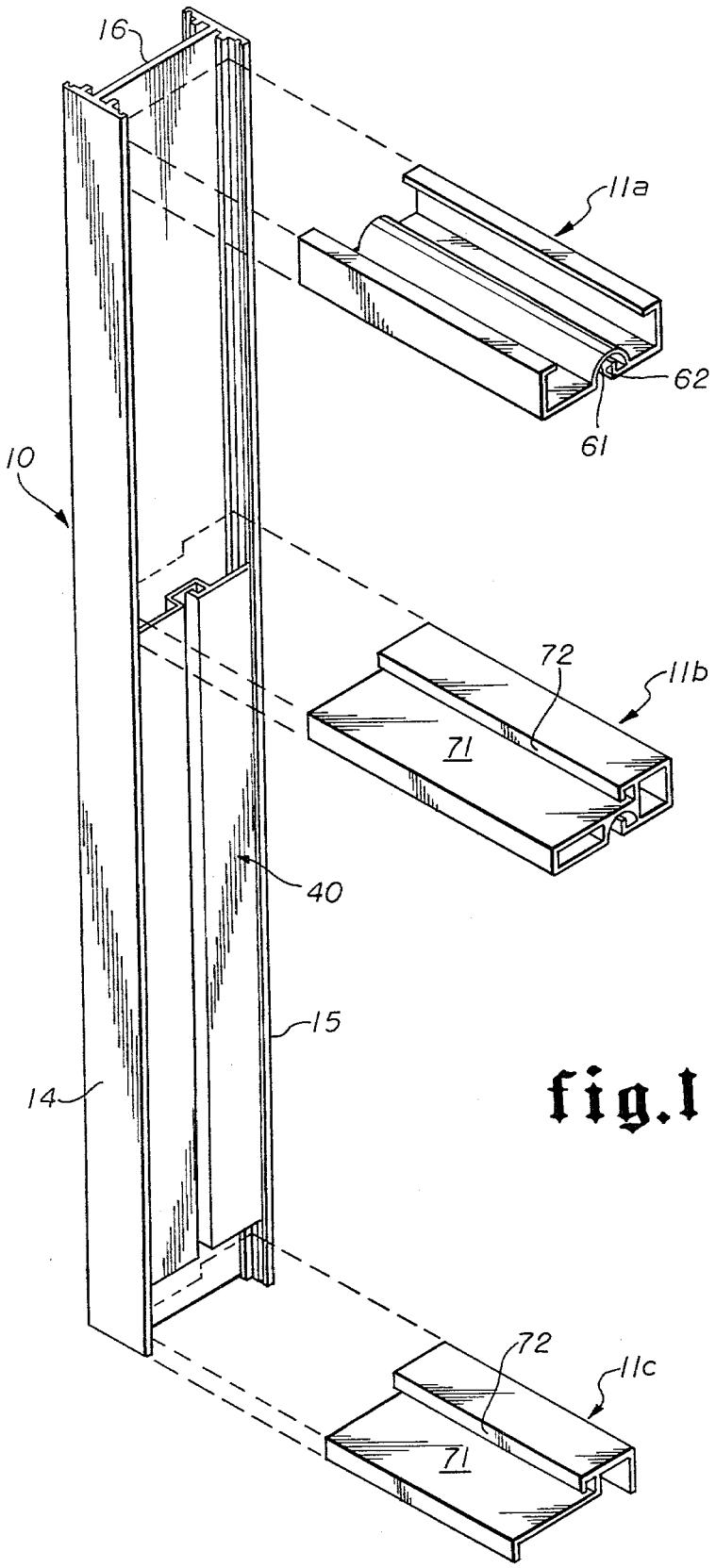
FIG. 1 is an exploded perspective, of the left hand frame portion, some horizontal parts being broken for ease of presentation.
Figure 2:
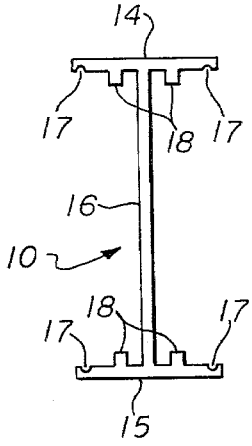
FIG. 2 is a top plan view of the vertical I-beam.

It should be understood that the following description is primarily concerned with the frame structure and assembly method of this invention, and not with all the niceties of full window installation, such as leveling, felt installation and the like.

The principal structural members are normally fabricated of extruded aluminum. These are exemplified by vertical members (verticals) 10 and horizontal members (horizontals) 11*a* (upper), 11*b* (intermediate) and 11*c* (bottom). Each vertical 10 is of I-beam configuration having opposite flanges 14, 15 connected by web 16. Each such flange includes longitudinal slots or notches 17 on one face of its opposite extremities, as well as spaced lugs or ridges 18 on opposite sides of web 16.

Figure 3:
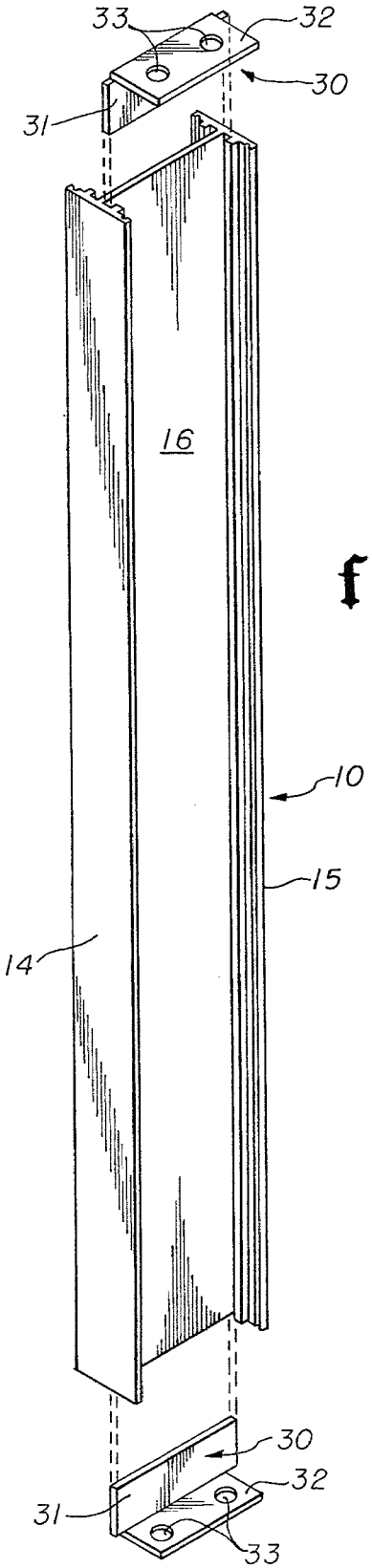
FIG. 3 is a perspective of a clip being assembled to an I-beam.

Connectors or clips 30, see FIG. 3, include vertical body 31 and right angled flanged 32, which would normally be apertured as at 33, to accommodate fasteners.

Figure 4:
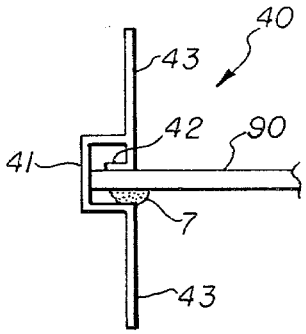
FIG. 4 is a top plan view of a filler with glass installed therein.

Fillers, or accurately spacers, 40, see FIG. 4, include elongated rectangularly configured housing 41 having an opening formed by L-shaped flange 42, and lateral wings 43 joined to opposite sides of such housing.

Horizontals 11*a*, 11*b*, and 11*c*, also of extruded aluminum, may have slightly different configurations, so as to accommodate panes of glass. Upper horizontal, or horizontal header 11*a* is shown to be of substantially U-shaped configuration with the central web portion upwardly bent, as at 61, to accommodate the upper edge of a glass pane. A shoulder 62 is formed within bend 61 to allow such glass pane to rest thereagainst. Intermediate horizontal 11*b* would have its lower surface configured like that of member 11*a*, but its upper surface includes shelf 71 and ledge or shoulder 72, on and against which the glass pane may find support. Bottom horizontal 11*c* would include on its upper surface such a shelf 71 and shoulder 72, but have its lower surface of the relatively open configuration shown in FIG. 1.

Figure 5:
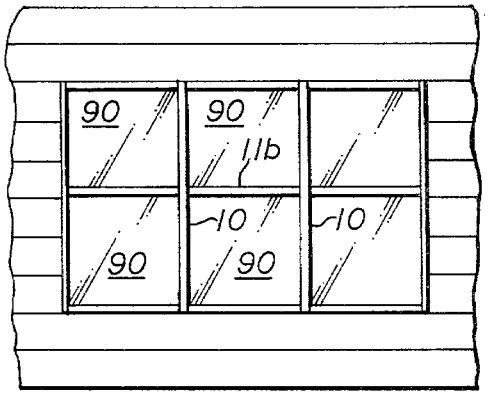
FIG. 5 is a front elevation of an assembled pane.

Consider now the assembly of the frame in an opening in a building wall such as illustrated at 90 in FIG. 5. Recall that the assembly personnel in the field can take lengths of extruded verticals and horizontals and cut them to size at the construction site. Initially, a horizontal 11*c* would be anchored to the structure surrounding the window opening. Such anchoring is facilitated by first inserting clip body 31 within a vertical 10, on one side of web 16, extending thereacross, intermediate such web and spaced ridges 18, see FIG. 3 Such web and spaced ridges forming a pocket therebetween to receive body 31 of member 30. Fasteners then may be used to engage such structure surrounding the building opening. Then a similar vertical would be so attached to the structure at the desired lateral distance from the first vertical and said horizontal 11*c* would be snapped into facing portions of the two verticals. One end of member 11*c* would rest approximately against the nearest face of ridge 18. The next step would involve the snapping of lateral wings 43 of fillers 40 of proper height, into slots or notches 17 of vertical flanges 14, 15 on the same side of horizontal web 16, in each vertical. This would result in filler housing 41 being positioned closely adjacent webs 16. Atop such fillers, intermediate horizontal 11*b* would be snapped into facing portions of the two verticals. The additional fillers 40 would be snapped into the I-beam verticals, as described above. Next the upper horizontal, or horizontal header 11*a* would be snapped into the verticals 10, resting atop fillers 40, and in front of clip or anchoring means body 31. It should be noted that when the horizontals are fully snapped into verticals 10, the ends of such horizontals rest closely adjacent ridge 18. At this stage the frame of this invention is complete. It goes without saying that glass panes 90 would be positioned with their lateral edges being accommodated by the openings in filler housings 41, and rest against shoulders 42. In FIG. 1, the lower pane edge would rest on shelf 71 and against ledge 72, and the upper edge be retained within the bend in the lower surface of intermediate horizontal 11*b*. The upper pane would have its upper edge so retained within bend 61 of the horizontal header 11*a*, and its lower edge rest on shelf 71 and against ledge 72 of intermediate horizontal. Further finishing touches would normally be accomplished, such as felting or the like. Finally, it is pointed out that by virtue of the I-beam construction of the verticals, a plurality of side by side frames is permitted, as appear in most commercial structures.

Although only a single embodiment has been described, it should be obvious that numerous modifications would be possible by one skilled in the art without departing from the spirit of the invention, the scope of which is limited only by the following claims.

We claim:

1. A window frame assembly including:

a plurality of spaced vertical members of I-beam construction, each such vertical member having a web centrally thereof and flanges perpendicular to and on opposite sides of said web;

each of said flanges includes, near both their lateral edges, (1) means for receiving axially extended spacers, said spacer receiving means comprising axially extended notches, (2) lateral ridges for abuttingly receiving the ends of horizontal members, and (3) pockets, intermediate said lateral ridges and said web, for receiving anchoring members;

a plurality of spaced horizontal members, each having its ends positioned in adjacent vertical members adjacent said vertical members' flange ridges;

a plurality of vertical extending spacers each having its lateral edges positioned within said spacer receiving means of adjacent ones of said flanges of said vertical members, each of said spacers having, centrally thereof, a vertically extending pane edge receiving housing positioned adjacent the web of a vertical member, the lower and upper edges of each of said spacers being positioned adjacent to a horizontal member, and each such edge either supporting or being supported by, one of said horizontal members; and upper and lower anchoring members partially inserted within said pockets for fixing said vertical members to a supporting structure.

* * * * *